US006446276B2

(12) United States Patent
Mathis

(10) Patent No.: US 6,446,276 B2
(45) Date of Patent: Sep. 10, 2002

(54) WALK-ON TRAY FOR CONCEALING A POOL COVER OPERATION SYSTEM

(75) Inventor: Wesley L. Mathis, West Jordan, UT (US)

(73) Assignee: Pool Cover Specialists National, Inc., Sandy, UT (US)

( * ) Notice: Subject to any disclaimer, the term of this patent is extended or adjusted under 35 U.S.C. 154(b) by 0 days.

(21) Appl. No.: 09/725,636

(22) Filed: Nov. 29, 2000

Related U.S. Application Data

(60) Provisional application No. 60/168,170, filed on Nov. 30, 1999.

(51) Int. Cl.[7] ..... E04H 4/14
(52) U.S. Cl. ..... 4/502; 4/496; 4/500
(58) Field of Search ..... 4/496, 498, 500–502; 248/226.11, 228.5, 235

(56) References Cited

U.S. PATENT DOCUMENTS 3,019,450 A * 2/1962 Karasiewicz ..... 4/502
3,050,743 A 8/1962 Lamb
3,076,975 A 2/1963 Lamb
3,748,664 A 7/1973 Morita
4,234,973 A * 11/1980 Vetter et al. ..... 4/500
4,815,152 A 3/1989 MacDonald et al.
5,044,022 A 9/1991 Hess
5,327,590 A 7/1994 Last
5,913,613 A 6/1999 Ragsdale et al.
5,927,042 A * 7/1999 Last ..... 4/500
6,324,706 B1 * 12/2001 Epple ..... 4/502

* cited by examiner

*Primary Examiner*—Charles R. Eloshway
(74) *Attorney, Agent, or Firm*—Clayton, Howarth & Cannon, P.C.

(57) ABSTRACT

A walk-on tray for concealing a pool cover operation system. The system includes a plurality of brackets each having a load-bearing upper portion. The brackets are attached to a sidewall of an elongate recess formed at one end of a pool, such that the load-bearing upper portions of the brackets extend in a substantially horizontal orientation. A plurality of platform sections each include a platform piece and an attachment plate moveably disposed below an under side of the platform piece, and a nut-tightening arrangement such that the load-bearing upper portions of the brackets may be securely sandwiched between the under side of the platform piece and the attachment plate, such that said platform sections reside in a side-by-side, sequential series. The platform sections include a mortar veneer insert, and mortar designs may be chosen and customized to modify an appearance of the mortar veneer to match an appearance of perimeter sections of a pool deck.

7 Claims, 1 Drawing Sheet

WALK-ON TRAY FOR CONCEALING A POOL COVER OPERATION SYSTEM

CROSS-REFERENCE TO RELATED APPLICATIONS

This application claims the benefit of U.S. Provisional Application No. 60/168,170, filed Nov. 30, 1999, which is hereby incorporated by reference herein in its entirety.

STATEMENT REGARDING FEDERALLY SPONSORED RESEARCH OR DEVELOPMENT

Not Applicable.

BACKGROUND OF THE INVENTION

1. The Field of the Invention

The present invention relates generally to a load bearing, platform-style lid, and more particularly, but not entirely, to a walk-on tray for concealing a pool cover operation system.

2. Description of Related Art

It is known to place the workings of a retractable pool cover system in a recessed enclosure at one end of a pool. The pool cover system would typically include a flexible pool cover wound upon a drum, similar to a roll of carpet, for example. The drum is rotatably stored in the recessed enclosure for dispensing the flexible pool cover onto the pool during periods of non-use, and for retracting the pool cover back upon the drum during periods of use.

The benefits of a selectively dispensable and retractable pool cover are enhanced by recessing the pool cover drum system into the deck at one end of the pool, thereby concealing the drum system from immediate view. These and other benefits are, however, offset by the complication that the recessed pool cover system renders that entire side of the pool inaccessible to bathers, and interrupts the appearance of the pool deck with the workings of the cover system.

The prior art is thus characterized by several disadvantages that are addressed by the present invention. The present invention minimizes, and in some aspects eliminates, the above-mentioned failures, and other problems, by utilizing the methods and structural features described herein.

BRIEF SUMMARY AND OBJECTS OF THE INVENTION

It is therefore an object of the present invention to provide a walk-on tray platform for concealing a pool cover operation system.

It is another object of the present invention, in accordance with one aspect thereof, to provide such a platform that matches the appearance of the pool deck area immediately surrounding the pool.

It is a further object of the present invention, in accordance with one aspect thereof, to provide such a platform that is easier to install and use.

It is an additional object of the invention, in accordance with one aspect thereof, to provide such a platform that is sturdier.

The above objects and others not specifically recited are realized in a specific illustrative embodiment of a walk-on tray for concealing a pool cover operation system. The system includes a plurality of brackets each having a load-bearing upper portion. The brackets are attached to a side-wall of an elongate recess formed at one end of a pool, such that the load-bearing upper portions of the brackets extend in a substantially horizontal orientation. A plurality of platform sections each include a platform piece and an attachment plate moveably disposed below an under side of the platform piece, and a nut-tightening arrangement such that the load-bearing upper portions of the brackets may be securely sandwiched between the under side of the platform piece and the attachment plate, such that said platform sections reside in a side-by-side, sequential series. The platform sections include a mortar veneer insert, and mortar designs may be chosen and customized to modify an appearance of the mortar veneer to match an appearance of perimeter sections of a pool deck.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
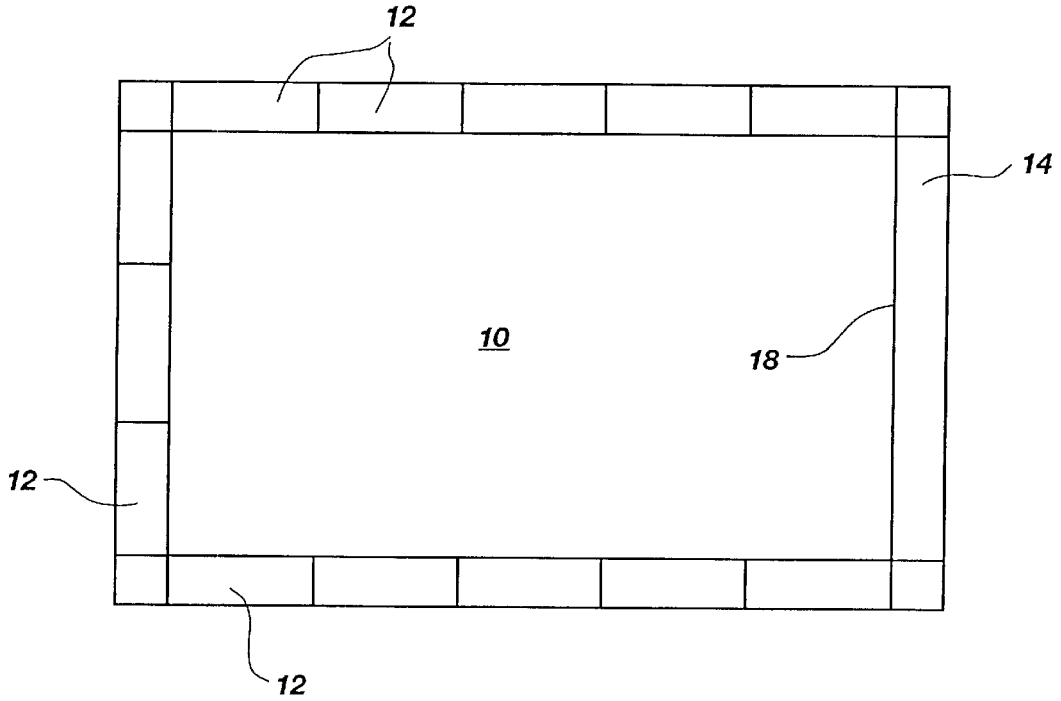
FIG. 1 is a schematic, plan view of a pool with decorative coping sections surrounding the perimeter of the pool.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

The invention is directed to a walk-on tray for concealing a recessed pool cover system. In FIG. 1 is shown a plan view of a pool 10, having traditional cementitious decorative perimeter (coping) sections 12 surrounding the perimeter of the pool 10 on three sides. On the fourth perimeter side of the pool 10 is an elongate recess 14 in which a rotational-drum pool cover retraction/placement device (not shown in FIG. 1) resides.

Figure 2:
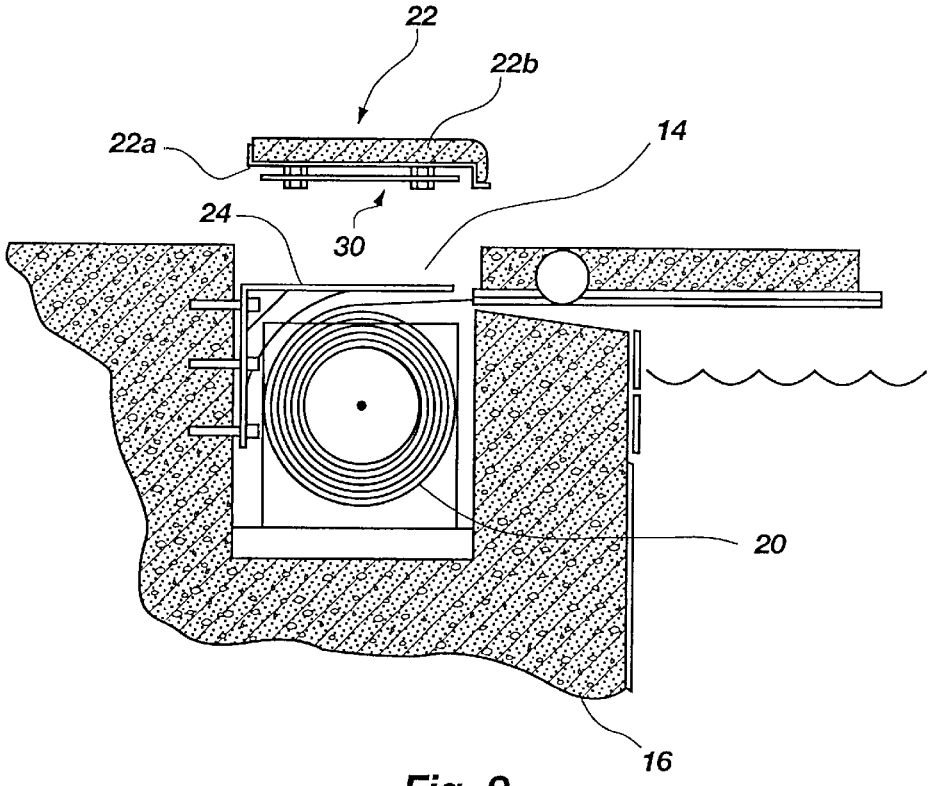
FIG. 2 is a side, break-away view of surrounding concrete forming one side of the pool and defining a recess in which resides a rotational pool cover drum system and a walk-on tray, made in accordance with the principles of the present invention, for concealing the pool cover system.

In FIG. 2 is shown a side, break-away view of surrounding concrete 16 forming side 18 of the pool 10, and a side view of the recess 14 in which a pool cover retraction/placement device 20 resides. Several walk-on trays 22, comprising an aluminum tray 22*a* and a mortar veneer 22*b* residing in the tray, are placed side-by-side over the recessed area 14 and attached to brackets 24 such that the trays 22 cover the recess 14. A simple, loose attachment plate 30 is used to attach the tray 22 to the brackets 24 by placing the plate 30 beneath the top portion of bracket 24 and tightening the nuts residing beneath the plate 30 to thereby secure the attachment plate 30 against the bracket 24.

The mortar veneer 22*b* is customized to match the appearance of the coping sections 12 surrounding the other sides of the pool 10.

It is to be understood that the mortar veneer 22*b* is much lighter and thinner that heavy thick concrete pieces that might be laid in stainless steel trays for use as a walk on tray. Among the improvements provided by the invention are thus the concepts of a thinner and lighter coping veneer piece, and a simple attachment means. The mortar veneer 22*b* is preferably less than 1.0 inches thick.

Aspects of the present invention may also be described as set forth below.

Description of Invention

A means for providing a top or "lid" for a recessed automatic-pool-cover mechanism which permits a (a) lightweight, (b) easy-to-install, (c) walk-on replication of the pool coping that surrounds the other three sides of the pool.

Details

1. Lid system consists of a number of aluminum trays containing expanded-aluminum welded to the surface and face of trays.

2. A ½" to ¾" layer of cement or cement epoxy or any other suitable type of mortar is poured into each tray, forming a laminated unit, matching the coping around the remaining three sides of the swimming pool.

3. The individual trays are secured to stainless-steel brackets mounted against the rear wall of the recessed cover housing by means of a plate previously fastened to the aluminum tray by tightening a bolt and rut. The installer slides the trays into place and secures same to the stainless steel brackets by tightening the nuts on the bottom of the tray, "pinching" the plate and bracket together.

4. Brick, stone, skip-troweled and other finishes can be applied after the coping is installed or the user may prefinish the trays to match the pool coping around the other three sides of the pool.

5. This lid system can be installed on any pool with a recessed-track (undertrack), regardless of the manufacturer of the automatic cover system.

Conventional methods that have permitted the installation of a recessed pool-cover-housing lid/cover have required the use of heavy, several-inch-thick coping-trays, which are difficult to handle, labor-intensive to install, and requires heavy brackets for support. The process of aligning the heavy coping stones is also time-consuming, primarily because of their weight and the heavy brackets required to support them. Typically, an installation takes eight to twelve hours and multiple trips to the installation site to accomplish. Since the tray/lid system of the present invention consists of much lighter trays, the use of a coping veneer (instead of thick coping trays), and a vastly simplified means of attaching the trays to lighter-weight brackets, the entire job of installing a custom-lid system is simplified, typically reducing the installation-time to two to three hours.

Because the lid system of the present invention consists of much lighter-weight trays and brackets, which are significantly less costly to produce than the heavier trays and brackets required of existing technology, significant savings can be achieved, using the new technology. Additionally, existing technology mandates a coping treatment (coping stones, brick, stone, cantilevered concrete, etc.,) identical in composition to the coping treatment surrounding the other three sides of the pool; however, the new technology utilizes a coping veneer to cover the recessed housing, which merely replicates the coping surrounding the remaining three sides of the pool, reducing the cost of the lid system even further.

The nature of the new lid-system technology is such that walk-on lids can be easily retrofitted to existing cover-mechanism housings. The existing-technology lid system can not be retrofitted to existing pool cover housings, because of the unique housing specifications required to install the bulky, heavy tray lids.

Since the new coping lids are light weight and can easily be removed and later re-secured to the brackets designed to hold them, service and maintenance to pool cover systems with walk-on tray lids is vastly simplified and is less labor intensive.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An apparatus for concealing a pool cover operation system, said apparatus comprising:

a plurality of brackets each having a load-bearing upper portion;

bracket attachment means for attaching the brackets to a sidewall of an elongate recess such that the load-bearing upper portions of said brackets extend in a substantially horizontal orientation;

a plurality of platform sections;

platform attachment means for attaching the platform sections to the load-bearing upper portions of the brackets such that said platform sections reside in a side-by-side, sequential series.

2. The apparatus of claim 1, wherein the platform attachment means further comprises an attachment plate and means for sandwiching the load-bearing upper portion of one of the brackets between an underside of one of the platform sections and the attachment plate.

3. The apparatus of claim 1, further comprises means for modifying an appearance of an upper portion of the platform sections to match an appearance of perimeter sections of a pool deck.

4. The apparatus of claim 1, wherein the platform sections each further comprise a metal tray and a mortar veneer disposed upon said metal tray.

5. The apparatus of claim 4, wherein the mortar veneer is less than 1.0 inches thick.

6. The apparatus of claim 4, wherein the mortar veneer is less than 0.8 inches thick.

7. The apparatus of claim 4, wherein the mortar veneer is less than 0.6 inches thick.

* * * * *

UNITED STATES PATENT AND TRADEMARK OFFICE
Certificate

Patent No. 6,446,276 B2 Patented: September 10, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Wesley L. Mathis, West Jordan, UT; David B. Dalton, Herber City, UT; and Matthew D. Greeff, Herriman, UT.

Signed and Sealed this Seventh Day of February 2006.

JUSTINE R. YU
*Supervisory Patent Examiner*
Art Unit 3751